United States Patent [19]

Salenbo

[11] 4,224,781

[45] Sep. 30, 1980

[54] APPARATUS FOR HANDLING OF UNSEALED SLIT BOXES

[75] Inventor: Sten Salenbo, Malmö, Sweden

[73] Assignee: Sundpacma Aktiebolag, Malmö, Sweden

[21] Appl. No.: 4,538

[22] Filed: Jan. 18, 1979

[51] Int. Cl.[3] ..... B65B 5/06

[52] U.S. Cl. ..... 53/473; 53/249

[58] Field of Search ..... 53/249, 250, 251, 252, 53/374, 473

[56] References Cited

U.S. PATENT DOCUMENTS

| | | | |
|---|---|---|---|
| 3,323,283 | 6/1967 | Johnson et al. | 53/250 X |
| 4,079,573 | 3/1978 | Livingston et al. | 53/374 X |

*Primary Examiner*—Travis S. McGehee

*Attorney, Agent, or Firm*—Larson, Taylor and Hinds

[57] ABSTRACT

An apparatus for handling of unsealed slit boxes (2) of the type having at least at the bottom thereof two pairs of close flaps (3, 4), and which comprises a cradle-like support (11) in the form of a U-bar which is open at the top and which at the bottom is formed with a guide and lock bar (17) having two lock plates (19, 20) provided spaced one above the other and spaced from the bottom of the cradle support and between which two opposite close flaps (4) at the bottom of the slit box (2) can be introduced and moved in the longitudinal direction of the cradle support while retaining the slit box and preventing the slit box from moving upwards. In a preferred embodiment of the invention the cradle support (11) is mounted on a Z-bar (12) which is rotatable about a horizontal axis (13) and which is actuatable by a piston-cylinder unit (21) to be rotated from an initial horizontal position for receiving and discharging the slit box (2) to a substantially vertical position in which the slit box (2) receives the goods to be packed.

13 Claims, 6 Drawing Figures

APPARATUS FOR HANDLING OF UNSEALED SLIT BOXES

The present invention generally relates to packing machines, and the invention is more particularly directed to an apparatus in machines for packing goods in so called slit boxes, especially in mechanized introducing of the goods into the slit box.

A slit box of the type referred to in connection with the present invention may be made of cardboard or any other material and is at least at the bottom formed with two pairs of close flaps extending in two directions perpendicular to each other. The close flaps make a closing of the bottom and the top respectively of the slit box possible. The said closing is made so that two opposite flaps are fold in whereupon the two remaining opposite flaps are folded over the first mentioned flaps and are secured in their folded in position by means of stitches, pasted strips or similar means.

In previously known packing machines, in which the goods are collected to units to be packed in slit boxes, the said boxes generally are erected and the bottoms thereof are closed in a separate operation before the boxes enter the machine line in which the units of goods are introduced into the slit box and after the said introduction of the goods to be packed the slit box and the goods are transferred to a subsequent station for closing and sealing of the box at the top.

The said previously known method is disadvantageous in some respects. The bottom closing and the introduction of the bottom-closed slit box in the packing line involves a step which is often made by hand and which may therefore cause a stop point of the continuous work operation. Since the slit box necessarily must be closed at the top after the goods are introduced into the box it would be advantageous if both the bottom closing and the top closing could be made in one single operation. In mechanical handling of the bottom-closed slit box the goods to be packed must either be introduced from above in an upright standing slit box or the slit box must be rotated so that the goods can be pushed horizontally into the box. In the first mentioned case the machine must be equipped with complicated and expensive lift and handling means for the goods to be packed which means may fail or may damage the goods. In the latter case the handling means for the slit box must be formed with bars, clamps or similar means which keep the box clamped during the rotation thereof so that the box does not move away from the rotation means and so that the box comes into position just in front of the collected goods to be packed. Such bars, clamps or similar means may make the introduction of the goods in the box difficult, and often the said means must be formed so as to be movable by means of guide cams or similar means so that the slit box is clamped while being rotated. In both cases the handling means is rather expensive and complicated and can easily cause operation troubles.

The basis of the invention therefore is the problem of providing an apparatus for handling slit boxes, especially in connection with filling the boxes with goods which are manufactured and/or collected in a line in direct connection to the handling apparatus of the slit box. An essential feature of the invention is that the apparatus is formed so that the slit box is handled unsealed both at the top and at the bottom, and that the means for guiding and holding the slit box during the said handling is fixed means which keep and guide the slit box by means of portions of the slit box itself, especially the close flaps and the sides of the slit box. The apparatus is formed so that the slit box is retained without the action of bars plates or other means at or adjacent the top of the box, which means may make the introduction of the goods into the box difficult, and without the action of movable parts which, over cam means, clamp the slit box as in some previously known apparatus. The apparatus according to the invention can be utilized separately in all kinds of handling of slit boxes or other boxes having two pairs of bottom close flaps, and preferably it can be used as an attachment unit for available packing machines to provide a more completely mechanized or automatic handling of such machines.

The invention will now be described more in detail with reference to the accompanying drawings. It is, however, to be understood that the embodiment illustrated in the drawings and described in the following specification is only an illustrative example and that all kinds of different modifications may be presented within the scope of the appended claims.

In the drawings

Figure 1:
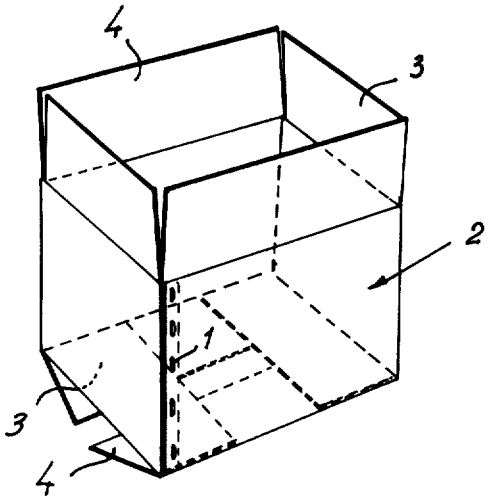
FIG. 1 is a perspective view of an embodiment of a slit box of the type which is intended to be handled by the apparatus according to the invention and in position for such handling.

The box illustrated in FIG. 1 can be made of cardboard or any other suitable material and it is made by being punched out of a plane blank which is folded to tubular form and is maintained in this position by means of stitches 1, glue or similar means. At least at the bottom but preferably also at the top the slit box 2 is formed with two pairs of close flaps, namely inner flaps 3 and outer flaps 4. The said flaps are utilized for handling of the slit box in that the box is supported by the inner flaps and the lower edges of the sides whereas the outer flaps keep the box so that it cannot be moved upwards. This will be explained further below.

Figure 2:
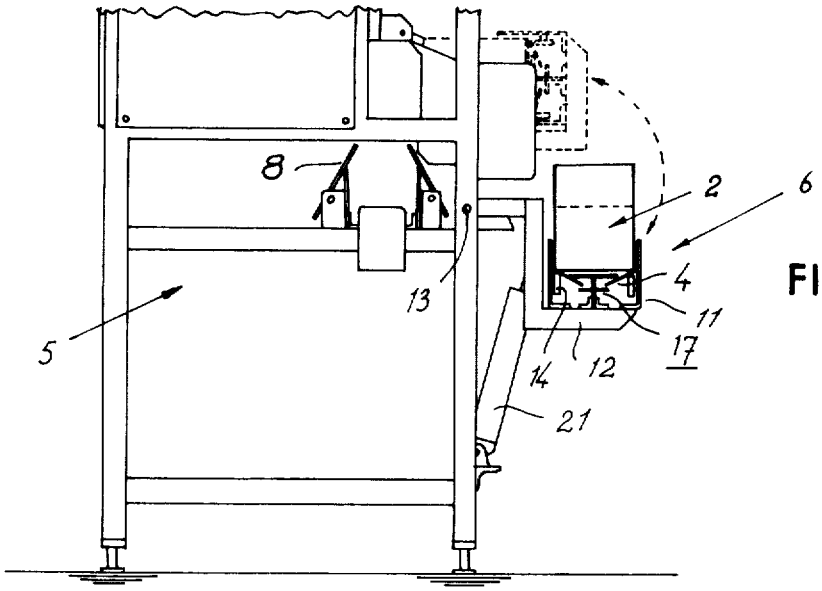
FIG. 2 illustrates diagrammatically and in an upright projection an apparatus according to the invention.
Figure 3:
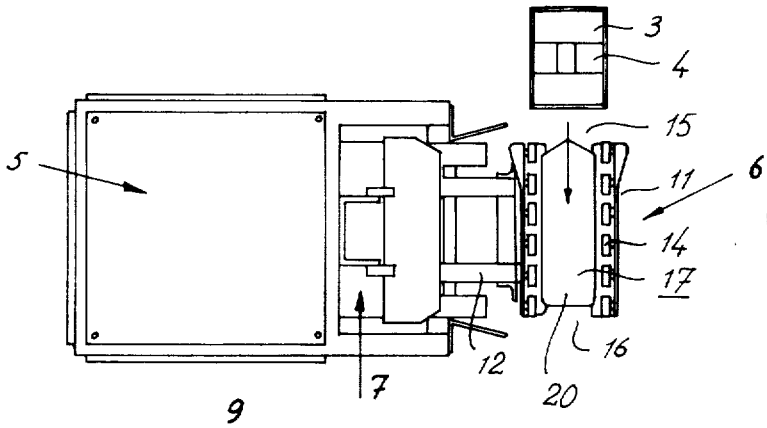
FIG. 3 shows the same apparatus from above.

The apparatus diagrammatically illustrated in FIGS. 2 and 3 generally comprises a machine 5 for manufacturing or collecting of products or a group of products to be packed in a slit box 2 or the like and to the packing machine is connected an apparatus 6 according to the invention for handling of slit boxes 2.

The machine 5 can be of a conventional type in which a product or a group of products are fed on a conveyor in the direction according to the arrow 7, pass a sensing or stopping means 8 and are collected in a position for being introduced into a container or box. A pusher 10 is provided for pushing the product 9 or group of products into the container or box, whereby the pusher following a predetermined time interval pushes the product 9 aside thereby pushing the product into a prepared container or box.

The handling apparatus 6 may be stationarily mounted, whereby the packing machine is preferably formed with means for moving the goods from above into the box or the introduction from above of the goods may be made by hand. Preferably, however, the handling means 6 is rotatable in a vertical plane, whereby it moves a prepared box upwards by a rotating movement into position for receiving the product. In the illustrated case the handling means comprises a cradle 11 in the form of an elongated U-formed bar which is open upwards and which is mounted on a bracket of Z-form which is rotatably mounted about a shaft 13 extending horizontally and parallel with the packing machine 5. The cradle 11 can be formed as two L-bars facing each other and which are adjustable for adapting same to different large boxes, and the L-bars are of such height as to give a side support for at least some portion of the sides of the box, however so that boxes of different heights can be handled. At the vertical sides the cradle is formed with runners 14 on which the filled box moves and by means of which the box can easily be moved from the feeding end 15 to the discharge end 16. The feeding end preferably is connected to a box or container erecting apparatus (not illustrated), and the discharge end preferably is directly connected to a means for sealing the box (not illustrated). Along the cradle 11 a guide and lock bar 17 extends which is mounted and secured at the bottom of the cradle or at the supporting bracket 12. The said bar comprises a vertical upright member 18 and two horizontal lock bars or plates 19, 20 provided spaced from each other and from the bottom of the cradle in the vertical direction. The lower one of said lock bars 19 is slightly narrower than the upper bar 20 in order to facilitate an introduction of the outer flaps 4 of the box between the two bars 19 and 20. The upper surface of the upper bar 20 is located on the same level as the runners 14.

Figure 5:
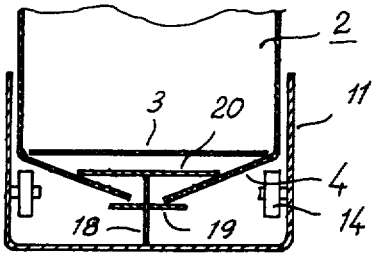
FIG. 5 shows a portion of the apparatus before the packing goods are placed in the box, and FIG. 6 correspondingly shows the apparatus after the goods are put in the box.
Figure 6:
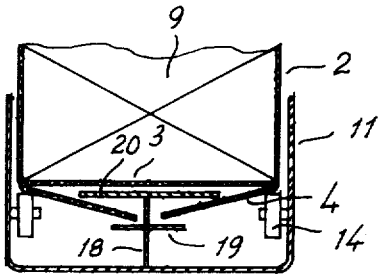

As best evident from FIG. 5 the empty slit box 2 is moved from the feeder end 15 into the handling apparatus with the outer flaps 4 of the bottom positioned between the horizontal lock bars 19 and 20. The lower bar 19 thereby prevents the flaps 4 from rotating downwards thereby releasing the box 2, and the upper bar 20 retains the box in the cradle 11 by the contact between the said bar 20 and the upper surfaces of the flaps 4. Depending on the springy action between the flaps and the sides it can be kept on a level slightly above the runners 4 in the unfilled state, but as soon as the box is filled it stands on the runners 14 to provide an extremely easy handling thereof.

Figure 4:
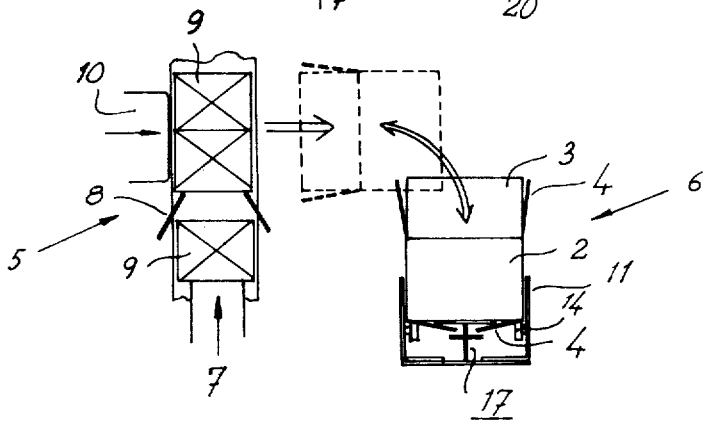
FIG. 4 illustrates more diagrammatically the operation of the apparatus.

When a box has been pushed into the handling apparatus the cradle 11 is rotated about its pivot shaft 13 to the position indicated with dotted lines in FIG. 4 supported by the bracket 12 and actuated by a hydraulic or pneumatic piston-cylinder motor 21. In the raised position indicated with the dotted lines in FIG. 4 the box is turned with the open top to the product 9 to be packed. Upon actuation of the pusher 10 the product 9 is pushed into the box 2, whereupon the cradle 11 is rotated back to its initial position, and the filled box is pushed out through the discharge end 16 for being subsequently sealed. The pushing out of the filled box preferably is made by introducing a new un-filled box which is possible since the box is supported by the runners 14. The motor 21 for rotating the filled box is preferably synchronized with means in the packing machine 5 and with means in the apparatus (not illustrated) for erecting the box, so that a continuous handling is provided of the products. As previously mentioned the cradle may be stationary or rotatable, and the rotation thereof may be made at any angle between 0° and 90°.

I claim:

1. An apparatus for handling unsealed boxes of the type formed at its bottom with a pair of opposed major flaps and a pair of opposed minor flaps, comprising:

a cradle-like support in the form of a generally U-shaped channel open at its top and open at both ends, and including support means for receiving and supporting a box of the type described herein, said support means including an upper plate positioned to receive a box of the type described and to be positioned below said minor flaps and above the major flaps, said support means permitting the box to be supported by said upper plate, a lower plate located below the upper plate and positioned to be located below the major flaps and to thereby prevent movement of the box away from the upper plate, and means for moving the support means to another position for loading of the box while said upper and lower plates continue to be positioned between and below the flaps, respectively, whereby said support means serves the dual purpose of supporting the box for loading and positioning the bottom flaps for subsequent closing thereof.

2. An apparatus according to claim 1, said means for moving comprising means for turning the cradle from an upright position about an angle to a loading position.

3. An apparatus according to claim 2, said means for turning including means for moving the cradle from an upright vertical position, about an axis of 90° to a horizontal position, said pivot axis being parallel to the axis of the channel.

4. An apparatus according to claim 2, including, in combination with said apparatus, a machine for conveying products to be packed into the box, and wherein said loading position of the cradle is positioned to receive product directly from said machine.

5. An apparatus according to claim 1, wherein said support means comprises an upright member extending perpendicularly upwardly from the bottom of the cradle-like support, said upright member carrying the said upper plate at the upper end thereof and perpendicular thereto and carrying the lower plate at an intermediate height below the upper plate, whereby the major flaps can be introduced into the space between the upper and lower plates, one on each side of the said upright member.

6. An apparatus according to claim 5, wherein the lower plate is of a narrower width than the upper plate.

7. An apparatus according to claim 5, wherein the space between the upper and lower plates is open at both ends of the support means so that the major flaps of a box can be moved into the cradle and through said support means.

8. An apparatus according to claim 1, said cradle-like support comprising a pair of upright side members which are relatively movable in a transverse direction for adapting the cradle-like support to receive boxes of the type described of different sizes.

9. An apparatus according to claim 1, including runner means mounted on each side of the cradle-like support to support at least a portion of the weight of a box located in the channel on the upper support plate to facilitate movement of said box through the cradle-like support.

10. An apparatus according to claim 9, wherein the upper surface of the runner means is located at essentially the same height as the upper surface of the upper plate.

11. An apparatus according to claim 1, including a Z-like bracket connected at one end to a product conveying machine and connected at its other end to said cradle-like support, the end of said Z-like bracket attached to the said machine being pivotable about an axis parallel to the axis of the U-shaped channel, a piston and cylinder unit connected to the machine and to the Z-like bracket for moving the bracket between a lower position whereat the cradle-like support is upright to a raised position whereat the cradle-like support is turned about an angle for receiving product from the product conveying machine.

12. A method of supporting and loading a box of the type formed at its bottom with a pair of opposed minor flaps and a pair of opposed major flaps extending perpendicular to and located below the minor flaps, comprising the steps of:

placing a first plate between the major and minor flaps in a position to support the box and any articles placed therein, with the major flaps turned in towards the minor flaps but outside of the first plate, engaging the outer side of the major flaps with a second plate to prevent outward movement of the major flaps and thereby prevent movement of the box away from the first plate, and with the two plates thus positioned relative to the box, moving the entire box and the plates to a different position or orientation and loading the box at said different position or orientation.

13. The method of claim 12, wherein the moving step includes moving the box approximately 90° about a pivot axis to a loading position.

* * * * *